US010326227B2

(12) United States Patent
Miyamura et al.

(10) Patent No.: US 10,326,227 B2
(45) Date of Patent: Jun. 18, 2019

(54) TERMINAL FITTING AND CONNECTOR

(71) Applicants: AutoNetworks Technologies, Ltd., Yokkaichi, Mie (JP); Sumitomo Wiring Systems, Ltd., Yokkaichi, Mie (JP); SUMITOMO ELECTRIC INDUSTRIES, LTD., Osaka-shi, Osaka (JP)

(72) Inventors: Tetsuya Miyamura, Mie (JP); Masaaki Tabata, Mie (JP); Yasuo Omori, Mie (JP); Shunya Takeuchi, Mie (JP)

(73) Assignees: AutoNetworks Technologies, Ltd., Yokkaichi, Mie (JP); Sumitomo Wiring Systems, Ltd., Yokkaichi, Mie (JP); SUMITOMO ELECTRIC INDUSTRIES, LTD., Osaka-shi, Osaka (JP)

( * ) Notice: Subject to any disclaimer, the term of this patent is extended or adjusted under 35 U.S.C. 154(b) by 0 days.

(21) Appl. No.: 16/074,491

(22) PCT Filed: Jan. 24, 2017

(86) PCT No.: PCT/JP2017/002245
§ 371 (c)(1),
(2) Date: Aug. 1, 2018

(87) PCT Pub. No.: WO2017/138347
PCT Pub. Date: Aug. 17, 2017

(65) Prior Publication Data

US 2019/0044270 A1 Feb. 7, 2019

(30) Foreign Application Priority Data

Feb. 11, 2016 (JP) ..... 2016-024227

(51) Int. Cl.
*H01R 13/10* (2006.01)
*H01R 13/422* (2006.01)
*H01R 13/436* (2006.01)

(52) U.S. Cl.
CPC ..... *H01R 13/4362* (2013.01); *H01R 13/10* (2013.01); *H01R 13/422* (2013.01)

(58) Field of Classification Search
CPC ... H01R 13/10; H01R 13/422; H01R 13/4362
(Continued)

(56) References Cited

U.S. PATENT DOCUMENTS 6,547,594 B2 * 4/2003 Ichio ..... H01R 13/4361 439/595
6,582,242 B2 * 6/2003 Murakami ..... H01R 13/5219 439/271
(Continued)

FOREIGN PATENT DOCUMENTS

JP 11-329554 11/1999
JP 2001-185272 7/2001
(Continued)

OTHER PUBLICATIONS

International Search Report dated Apr. 11, 2017.

*Primary Examiner* — Edwin A. Leon
*Assistant Examiner* — Oscar C Jimenez
(74) *Attorney, Agent, or Firm* — Gerald E. Hespos; Michael J. Porco; Matthew T. Hespos

(57) ABSTRACT

It is aimed to improve a terminal holding force. A terminal fitting includes a terminal connecting portion (12) connectable to a mating terminal fitting, a wire connecting portion (13) disposed behind the terminal connecting portion (12) and to be connected to an end part of a wire, and a retainer locking portion (18) formed to project on the terminal connecting portion (12) and having a retainer locking sur-
(Continued)

face (22) to be locked by a retainer (5). The retainer locking surface (22) is formed into a reverse tapered shape from a projecting end side toward a base end side.

3 Claims, 8 Drawing Sheets

(58) Field of Classification Search
USPC ..... 439/345, 752, 878
See application file for complete search history.

(56) References Cited

U.S. PATENT DOCUMENTS

| | | | | |
|---|---|---|---|---|
| 2001/0049235 | A1 | 12/2001 | Furutani | |
| 2004/0005821 | A1 | 1/2004 | Nankou et al. | |
| 2011/0250804 | A1* | 10/2011 | Nishide | H01R 13/05 439/888 |
| 2017/0170589 | A1* | 6/2017 | Kida | H01R 4/18 |
| 2017/0324180 | A1* | 11/2017 | Natsume | H01R 13/03 |
| 2018/0248294 | A1* | 8/2018 | Hirota | H01R 13/4365 |

FOREIGN PATENT DOCUMENTS

| | | |
|---|---|---|
| JP | 2001-332335 | 11/2001 |
| JP | 2012-38494 | 2/2012 |
| JP | 2013-143302 | 7/2013 |

* cited by examiner

TERMINAL FITTING AND CONNECTOR

BACKGROUND

Field of the Invention

The invention relates to a terminal fitting and a connector.

Related Art

Japanese Unexamined Patent Publication No. 2001-332335 discloses a terminal fitting that is locked doubly in a cavity of a connector housing by a locking lance and a retainer. The terminal fitting includes a rectangular tubular terminal connecting portion to be connected to a mating terminal fitting. A rear end of the terminal connecting portion has an upright surface that is to be locked by a similarly upright surface on the retainer.

The above-described structures for locking the surfaces that are perpendicular to a withdrawing direction of the terminal fitting generally present no particular practical problem in producing a sufficient terminal holding force. However, if a connector is reduced in size and a terminal fitting also is thinned and reduced in size, a terminal holding force may not be sufficient if the above-described locking structure is still adopted.

Further, a strong pulling force on the terminal fitting may displace the retainer and release locking if the engagement margin between the upright locking surfaces is small.

The invention was completed on the basis of the above situation and aims to provide a terminal fitting capable of improving a terminal holding force by a simple configuration and a connector accommodating the terminal fitting.

SUMMARY

The invention is directed to a terminal fitting to be inserted into a connector housing from behind and retained and held in the connector housing by being locked by a retainer mounted into the connector housing. The terminal fitting includes a terminal connecting portion connectable to a mating terminal fitting. A wire connecting portion is disposed behind the terminal connecting portion and is configured to be connected to an end part of a wire. A retainer locking portion projects on the terminal connecting portion and has a retainer locking surface to be locked by the retainer. The retainer locking surface is formed into a reverse tapered shape from a projecting end toward a base end.

The present invention also is directed to a connector that has the above terminal fitting accommodated in the connector housing.

According to the invention, the retainer locking surface of the terminal fitting is formed into the reverse tapered shape. Thus, a pulling force on the terminal fitting in a withdrawing direction causes the retainer locking portion to bite into the retainer and lock more strongly. In this way, a terminal holding force can be improved. Further, even if an engagement margin between the retainer and the terminal fitting is small, the biting part is caught to prevent the terminal fitting from being unlocked.

The retainer locking portion may have a substantially U shape composed of a standing piece rising out from an outer surface of the terminal connecting portion and a folded piece folded from a rising end part of the standing piece toward the outer surface of the terminal connecting portion. Rear end surfaces of the standing piece and the folded piece are substantially flush with each other to form the retainer locking surface. A remaining part of the terminal fitting excluding the retainer locking surface has a plated surface with a plating layer laminated thereon, but the retainer locking surface is a non-plated surface having no plating layer.

In the process of manufacturing the terminal fitting, a base material first is stamped into a predetermined development shape. Subsequently, plating is applied to both sides of a stamped piece in a state of development and, thereafter, the plated piece is folded into a predetermined shape to assemble the terminal fitting. At this time, if the retainer locking portion is folded into a U shape, the retainer locking surface is also U-shaped as a matter of course. A region on a rising side and a region on a folded side of the U-shaped part both desirably are brought into contact with the retainer. However, there has been a possibility that the region on the rising side and the region on the folded side do not constitute the same surface due to a variation during bending and only one region may contact the retainer, with the result that a terminal holding force is reduced.

Accordingly, in the present invention, post-processing, such as cutting, is applied after the retainer locking surface is processed to be folded. Thus, the retainer locking surface becomes a non-plated surface, and the region on the rising side and the region of the folded side constitute the same surface and both regions contact the retainer. Thus, a predetermined terminal holding force can be obtained reliably.

Further, a lance locking portion may project on a side of the terminal connecting portion before the retainer locking portion. The lance locking portion may have a lance locking surface lockable by a deflectable locking lance formed in the connector housing. Additionally, the lance locking surface may be formed into a reverse tapered shape from a projecting end side toward a base end side. According to this configuration, since the lance locking surface can also bite into the locking lance, the terminal holding force can be improved further.

A specific embodiment of the invention is described with reference to the drawings.

A specific embodiment of the invention is described with reference to the drawings.

(Connector Housing 1)

Figure 1:
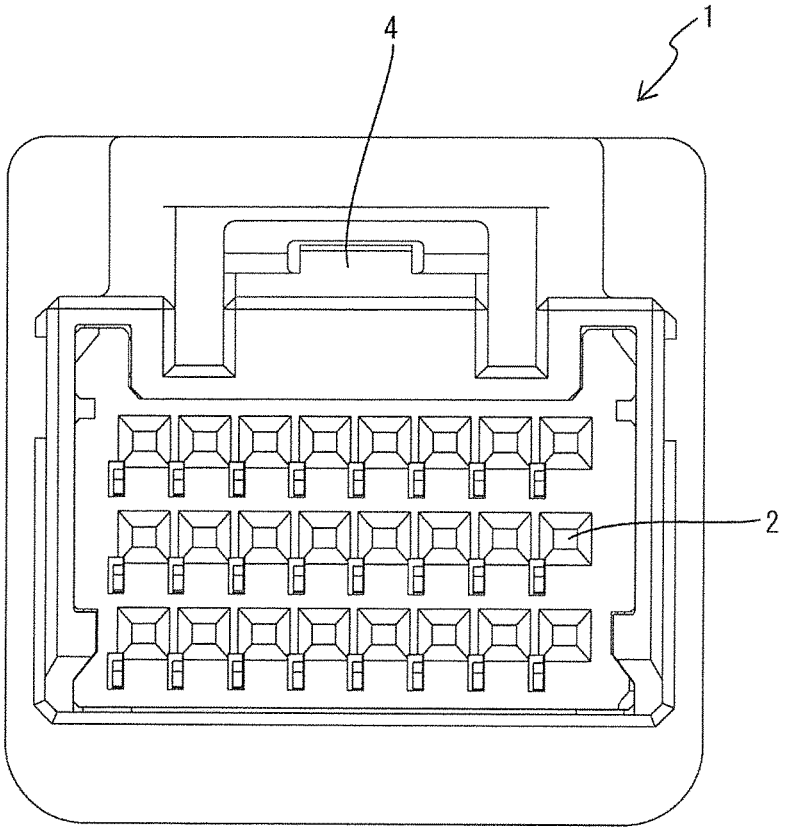
FIG. 1 is a front view of a connector housing.

The connector housing 1 shown in FIG. 1 is made of synthetic resin and has cavities 2 for accommodating terminal fittings T formed in each of three stages inside the connector housing 1. Each cavity 2 is formed along a front-rear direction and the terminal fitting T is insertable into each cavity 2 from behind.

A locking lance 3 for primarily locking the terminal fitting T is disposed at a position near a front end part inside each cavity 2. The locking lance 3 is cantilevered obliquely forward from a bottom surface of the cavity 2 and is deflectable in a vertical direction as shown (direction perpendicular to an inserting direction of the terminal fitting T). A front end surface 3A of the locking lance 3 is inclined when the locking lance 3 is in a natural state. Specifically, this inclined surface is formed with such an inclination that an end edge on the side of the cavity 2 is located on a front side in the inserting direction, and an opposite end edge is located on a rear side in the inserting direction.

Figure 2:
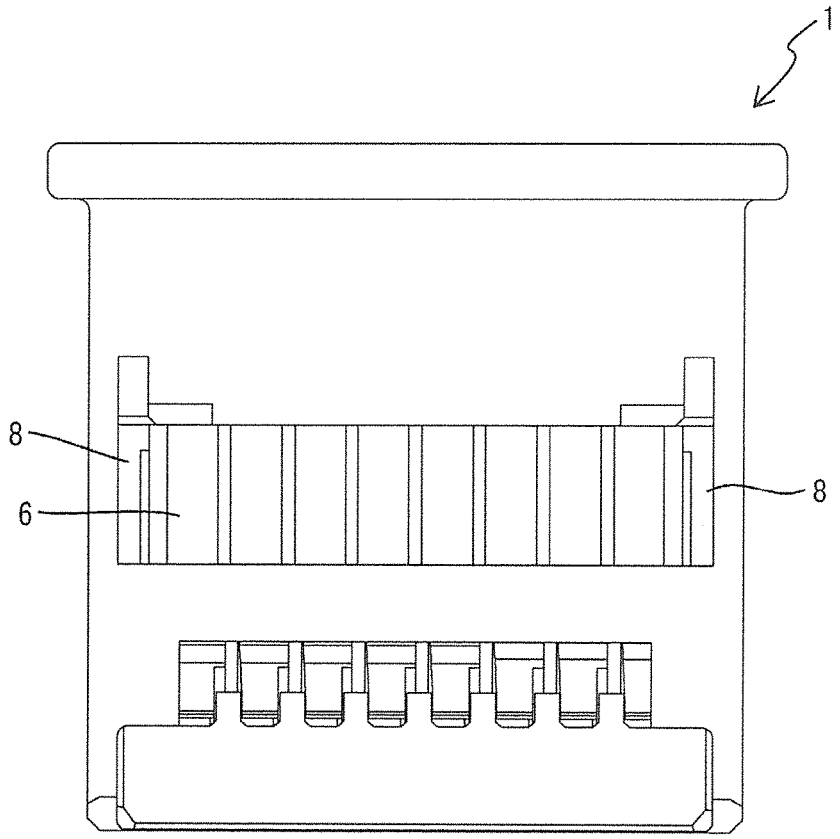
FIG. 2 is a bottom view of the connector housing.
Figure 9:
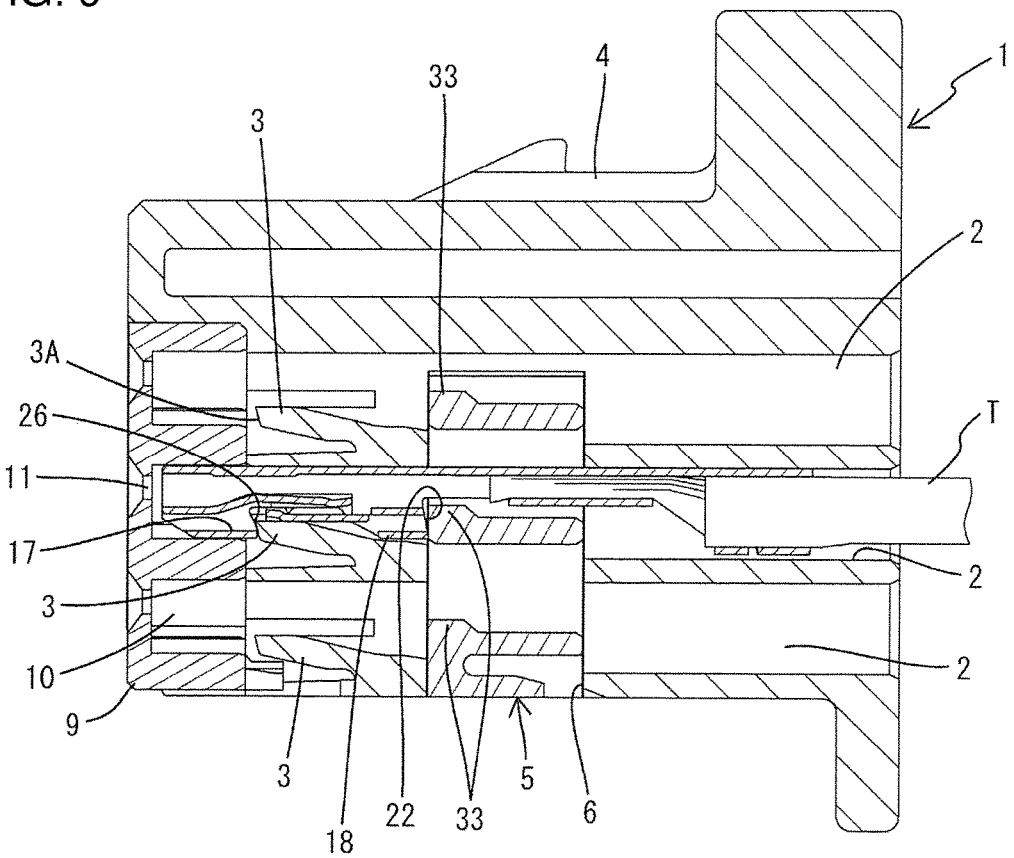
FIG. 9 is a side view in section showing a state where the terminal fitting is doubly retained by the retainer and a locking lance in the connector housing.

A deflectable lock arm 4 for locking a mating connector in a connected state is provided on the upper surface of the connector housing 1. On the other hand, as shown in FIG. 2, a retainer insertion hole 6 is open in a lower surface of the connector housing 1 and a retainer 5 can be inserted therein. The retainer insertion hole 6 is formed along a width direction of the connector housing 1 and divides all of the cavities 2 into front and rear sections behind the locking lances 3, as shown in FIG. 9. Further, opposite end parts of the retainer insertion hole 6 in the width direction serve as lock receiving portions 8. The lock receiving portions 8 are locked to retain the retainer 5 when locking legs 7 of the retainer 5 are inserted.

As shown in FIG. 9, a front holder 9 is mounted on a front surface of the connector housing 1. The front holder 9 is provided with accommodation recesses 10 communicating with the respective cavities 2 and configured to accommodate front end parts of the terminal fittings T. A front wall of the accommodation recess 10 stops the terminal fitting T in front and a tab insertion hole 11 is formed in the front wall to receive a tab of a mating terminal fitting.

(Terminal Fitting T)

The terminal fitting T is made of a thin conductive metal plate material as a base material. The base material is stamped into a predetermined development shape, and tin plating (or nickel plating) is applied to both sides of the stamped piece. The terminal fitting T in a development state after a plating process then is folded into the following form.

Figure 4:
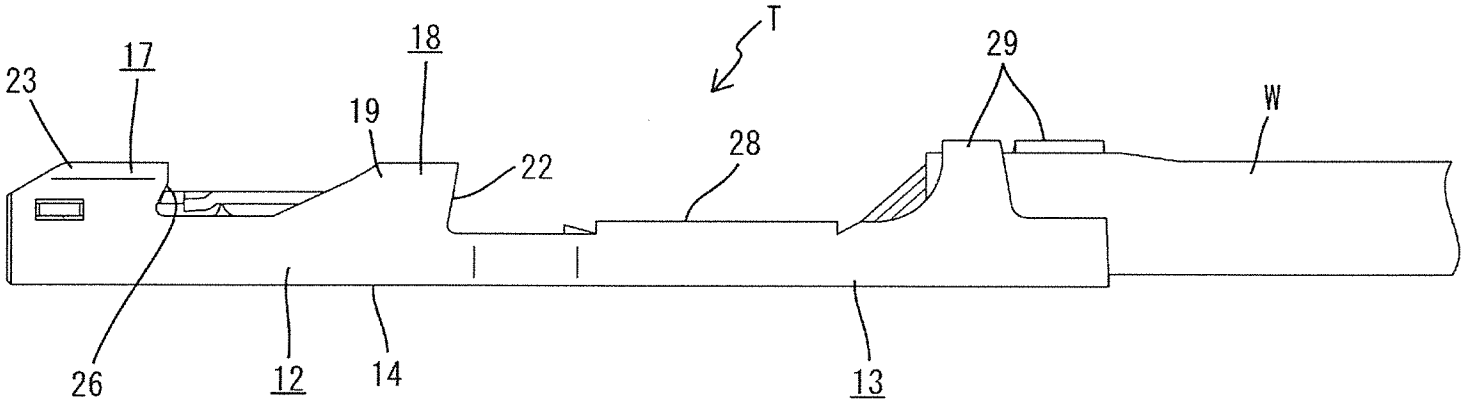
FIG. 4 is a side view of a terminal fitting.

As shown in FIG. 4, the terminal fitting T is composed of a terminal connecting portion 12 for connection to the mating terminal fitting and a wire connecting portion 13 for connection to a wire.

Figure 6:
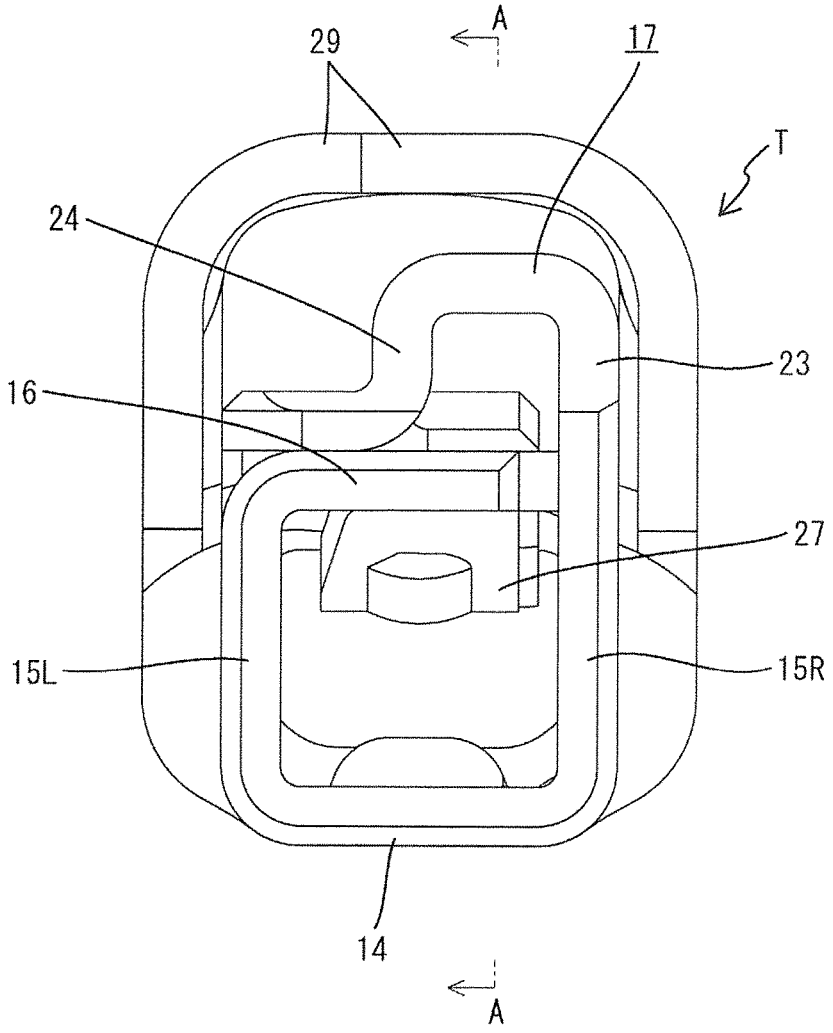
FIG. 6 is a front view of the terminal fitting.

The terminal connecting portion 12 is substantially in the form of a rectangular tube open both forward and rearward. As shown in FIG. 6, the terminal connecting portion 12 includes a bottom wall 14 flush with that of the wire connecting portion 13 and side walls 15R, 15L rising from both widthwise sides of the bottom wall 14. A ceiling wall 16 extends horizontally from a rising end of one side wall 15L (left side wall in FIG. 6) toward the other side wall 15R (right side wall in FIG. 6).

Figure 5:
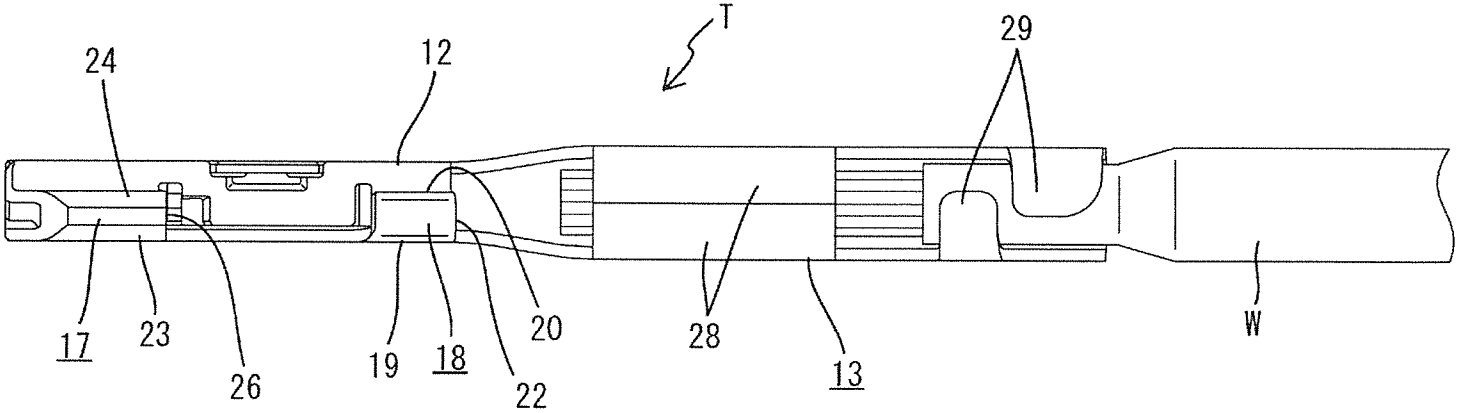
FIG. 5 is a plan view of the terminal fitting.
Figure 7:
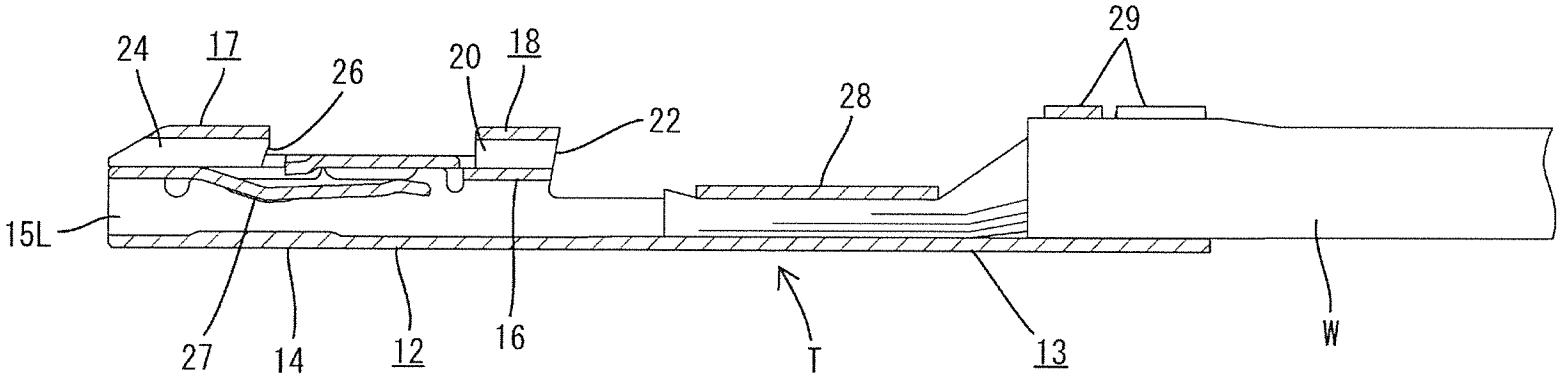
FIG. 7 is a section along A-A of FIG. 6.

As shown in FIGS. 4, 5 and 7, two projecting parts are provided separately on front and rear sides of a rising end edge of the right side wall 15R. The front part is a lance locking portion 17 to be locked by the locking lance 3 and the rear part is a retainer locking portion 18 to be locked by the retainer 5.

The retainer locking portion 18 projects from the rising end edge of the right side wall 15R while being formed into a substantially U shape in a back view. Specifically, the retainer locking portion 18 is formed with a standing piece 19 flush with and rising from the right side wall 15R, and a folded piece 20 extending substantially horizontally inward from a rising end of the standing piece 19 and folded toward the ceiling wall 16 from an extending end.

Figure 8:
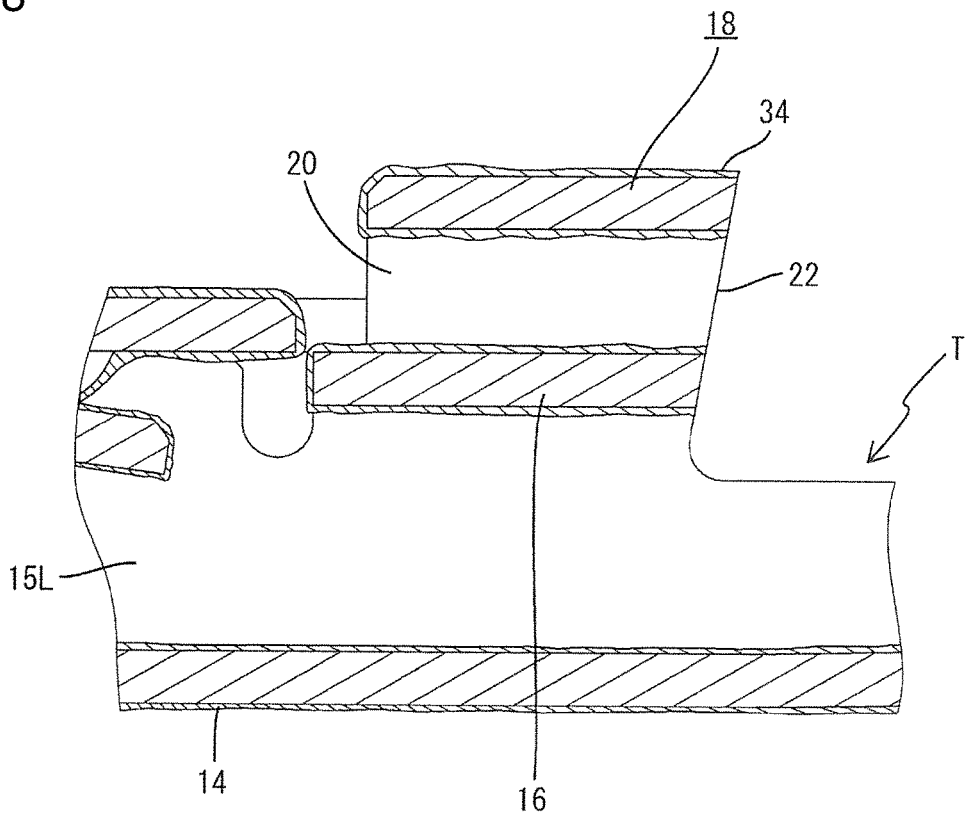
FIG. 8 is an enlarged section of a retainer locking portion.

Rear end surfaces of the standing piece 19 and the folded piece 20 serve as a retainer locking surface 22 to be locked by the retainer 5. As shown in FIGS. 4, 7 and 8, the retainer locking surface 22 is formed into a reverse tapered shape, i.e. formed into an inclined surface inclined forward in the inserting direction of the terminal fitting T from an outer end to a base end of the retainer locking portion 18. In other words, the retainer locking portion 18 is formed such that a length of a base side in the front-rear direction is longer than that of a tip side in the front-rear direction. In this embodiment, the retainer locking surface 22 is inclined continuously to a position including a rear end surface of the ceiling wall 16. Thus, a region of the terminal fitting T lockable by the retainer 5 is a range from the retainer locking surface 22 to the rear end surface of the ceiling wall 16.

The retainer locking surface 22 is formed by post-processing such as cutting after the terminal fitting T is assembled. By this cutting process, the retainer locking surface 22 is formed so that the rear end surfaces of the standing piece 19 and the folded piece 20 are coplanar. As a result, the retainer locking surface 22 is a non-plated surface by having a plating layer 34 scraped off, as shown in FIG. 8.

The lance locking portion 17 is provided on a front part of the terminal connecting portion 12. Similar to the retainer locking portion 18, the lance locking portion 17 also is folded into a U shape. Specifically, the lance locking portion 17 includes a rising piece 23 standing from the rising end edge of the right side wall 15R and a hanging piece 24 folded toward the ceiling wall 16 after extending horizontally in from an end edge of the rising piece 23.

A rear end surface of the lance locking portion 17 serves as a lance locking surface 26 to be locked by the locking lance 3. A slightly vertical part is formed on a projecting end part of this lance locking surface 26, and a height range from a lower end of the vertical part to the ceiling wall is processed into a reverse tapered shape, similar to the retainer locking portion 18. A gradient of the lance locking surface 26 is substantially equal to that of the front end surface of the locking lance 3 in a state where the locking lance 3 locks the terminal fitting T (substantially natural state). Further, an angle of inclination of the lance locking surface 26 to the vertical direction is larger than that of the retainer locking surface 22 to the vertical direction.

Similar to the retainer locking surface 22, the lance locking surface 26 also is formed by post-processing such as cutting after the terminal connecting portion 12 is assembled. Thus, the lance locking surface 26 is also a non-plated surface by having the plating layer 34 scraped off.

A resilient tongue 27 is provided inside the terminal connecting portion 12 and can establish electrical conduction by resiliently contacting the mating terminal fitting.

The wire connecting portion 13 is composed of a wire barrel 28 to be crimped to a core part of a wire W and an insulation barrel 29 disposed behind the wire barrel 28 and to be crimped to a coating part of the wire W.

(Retainer 5)

Figure 3:
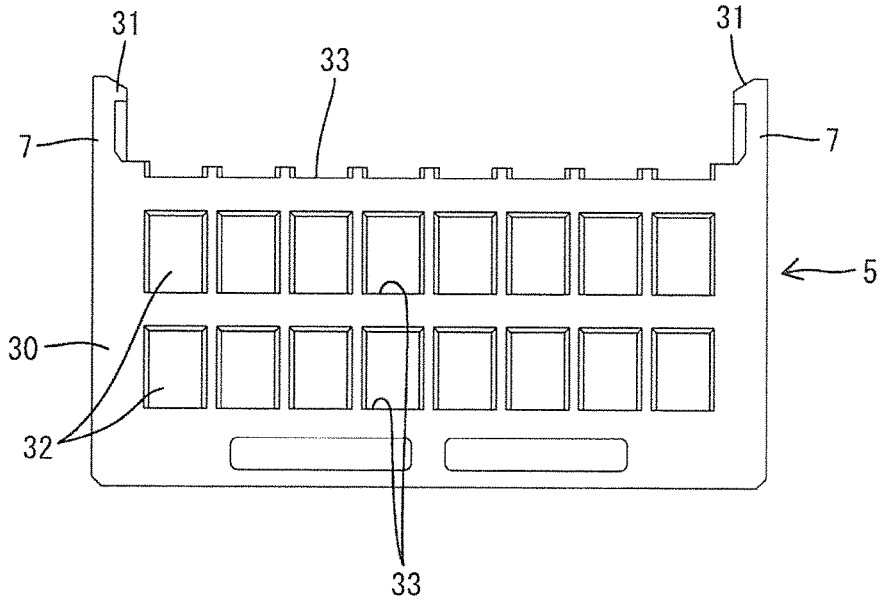
FIG. 3 is a front view of a retainer.

The retainer 5 is made of synthetic resin and includes a body 30 formed into a block. The retainer 5 is insertable into the retainer insertion hole 6 of the connector housing 1. As shown in FIG. 3, the two locking legs 7 are formed on opposite widthwise side edge parts of a front side (upper side in FIG. 3) of the retainer 5 in the inserting direction. A lock claw 31 is formed on a tip of each locking leg 7 and is deflectable in the width direction. Although not shown in detail, when the retainer 5 is inserted into the retainer insertion hole 6, the lock claw 31 locks at two positions in each lock receiving portion 8 of the connector housing 1 and the retainer 5 is held at each position. One position is a partial locking position where a mounting depth of the retainer 5 is shallow and the terminal fittings T freely can be inserted into and withdrawn from the cavities 2 at this position. The other position is a full locking position where the mounting depth of the retainer 5 is deep. The retainer 5 can lock the terminal fittings T at this position to doubly retain the terminal fittings T together with the locking lances 3.

As shown in FIG. 3, window holes 32 are open in two stages in a height direction in the body 30 of the retainer 5 so that the entire body 30 is formed into a lattice. When the retainer 5 is at the partial locking position, the window holes 32 can be aligned with and communicate with the respective cavities 2 in the corresponding stages (two stages located on a rear side in the inserting direction of the retainer 5) in the connector housing 1.

As shown in FIGS. 3 and 9, locking projecting edges 33 are formed integrally to project along the width direction on parts of opening edges of the respective window holes 32 located on rear sides in the inserting direction of the retainer 5 and on a front edge part of the body 30 in the inserting direction. Each locking projecting edge 33 is locked to the retainer locking surface 22 when the retainer 5 is at the full locking position shown in FIG. 9. As shown in FIG. 9, a front surface of each locking projecting edge 33 is a vertically upright surface in this embodiment.

When the retainer 5 is at the partial locking position, each locking projecting edge 33 is retracted outside an insertion path for the terminal fitting T to allow the insertion and withdrawal of the terminal fitting T. However, when the retainer 5 is moved to the full locking position, each locking projecting edge 33 projects into the insertion path for the terminal fitting T to face and lock the retainer locking surface 22.

Next, functions and effects of this embodiment configured as described above are described. With the retainer 5 held at the partial locking position, the terminal fittings T are inserted respectively into each cavity 2 from behind. While the terminal fitting T is moving forward in the cavity 2, the retainer locking portion 18 rides on the locking lance 3 to deflect the locking lance 3. The locking lance 3 resiliently returns to the substantially natural state when the terminal fitting T reaches a proper position to lock the lance locking portion 17 of the terminal fitting T. The lance locking surface 26 is formed into the reverse tapered shape. Thus, even if the wire is pulled in the primarily locked state, the terminal fitting T is caught to bite into the locking lance 3. Thus, the terminal fitting T is retained with a sufficient holding force in the primarily locked state. In addition, the gradients of the front end surface of the locking lance 3 and the lance locking surface 26 are substantially equal. Thus, these surfaces are locked to each other while being held in surface contact. This also contributes to an improvement of the terminal holding force in the primarily locked state.

When the terminal fittings T are inserted to the proper position into all the cavities 2 in this way, the retainer locking surfaces 22 are facing the retainer insertion hole 6 with almost no clearance defined therebetween. Subsequently, a pushing force is applied to the retainer 5 to move the retainer 5 from the partial locking position to the full locking position. When the retainer 5 reaches the full locking position, each locking projecting edge 33 of the retainer 5 locks the retainer locking surface 22 of the retainer locking portion 18 (secondarily locked state).

The retainer locking surface 22 is formed into the reverse tapered shape. Thus, if a pulling force is applied to the terminal fitting T, a tip part of the retainer locking surface 22 bites into the locking projecting edge 33. Thus, a high locking force is obtained. Even if an engagement margin of the locking projecting edge 33 with the retainer locking surface 22 is small, it is possible to avoid a situation where the locking projecting edge 33 is displaced from the retainer locking surface 22 and maintain the locked state by an effect of the reverse taper.

In addition, the retainer locking surface 22 is formed by cutting or the like after the terminal connecting portion 12 including the retainer locking portion 18 is bent. As described above, if the retainer locking surface 22 is formed in advance before bending, the rear end surfaces of the standing piece 19 and the folded piece 20 may be displaced in the front-rear direction without being coplanar during bending. However, by post-processing the retainer locking surface 22, as in this embodiment, the rear end surfaces of the standing piece 19 and the folded piece 20 reliably are made flush with each other. Thus, the rear end surfaces of the standing piece 19 and the folded piece 20 can be brought into contact with the locking projecting edge 33, and a wide locking area can be ensured as compared to the case where either one of these rear end surfaces is brought into contact, thereby contributing to an improvement of the locking force by the retainer 5. Note that this function is similarly exhibited also on the lance locking surface 26.

As just described, the locking force of the locking lance 3 to lock the terminal fitting T and the locking force by the retainer 5 both are increased in this embodiment. Thus, the terminal holding force can be improved drastically.

The invention is not limited to the above described and illustrated embodiment. For example, the following embodiments also are included in the scope of the invention.

Although the lance locking surface 26 is also formed into the reverse tapered shape in addition to the retainer locking surface 22 in the above embodiment, the lance locking surface 26 may be a vertically upright surface as before.

Although the lance locking portion 17 projects on the terminal fitting T to enable locking by the locking lance 3 in the above embodiment, a locking hole may be open in the terminal connecting portion 12 instead of the lance locking portion 17 and the locking lance 3 may be locked to this locking hole.

Although the retainer locking portion and the lance locking portion are both folded into a U shape to have a two-plate structure in the above embodiment, each of these locking portions may be formed by a single plate instead of the folding structure.

Although the present invention is applied to the female terminal fitting in the above embodiment, application to a male terminal fitting is also possible. In this case, the male terminal fitting includes a tab, a rectangular tube connected behind the tab and a wire connecting portion connected behind the rectangular tube. In the male terminal fitting, the terminal connecting portion of the present invention is defined by the tab and the rectangular tube.

LIST OF REFERENCE SIGNS

1 . . . connector housing
3 . . . locking lance
5 . . . retainer
12 . . . terminal connecting portion
13 . . . wire connecting portion
17 . . . lance locking portion
18 . . . retainer locking portion
19 . . . standing piece
20 . . . folded piece
22 . . . retainer locking surface
26 . . . lance locking surface

The invention claimed is:

1. A terminal fitting to be inserted into a connector housing from behind and retained and held in the connector housing by being locked by a retainer mounted into the connector housing, comprising:

a terminal connecting portion connectable to a mating terminal fitting;

a wire connecting portion disposed behind the terminal connecting portion and to be connected to an end part of a wire; and a retainer locking portion formed to project on the terminal connecting portion and having a retainer locking surface to be locked by the retainer;

wherein:

the retainer locking surface is formed into a reverse tapered shape from a projecting end side toward a base end side;

the terminal fitting has plating applied to both sides after being stamped into a predetermined shape from a base material;

the retainer locking portion is formed into a substantially U shape composed of a standing piece rising out from an outer surface of the terminal connecting portion and a folded piece folded from a rising end part of the standing piece toward the outer surface of the terminal connecting portion; and rear end surfaces of the standing piece and the folded piece are substantially flush with each other to form the retainer locking surface, a remaining part of the terminal fitting excluding the retainer locking surface has a plated surface having a plating layer laminated thereon, but the retainer locking surface is a non-plated surface having no plating layer.

2. The terminal fitting of claim 1, wherein a lance locking portion projects on a side of the terminal connecting portion before the retainer locking portion, the lance locking portion has a lance locking surface lockable by a deflectable locking lance formed in the connector housing, and the lance locking surface is formed into a reverse tapered shape from a projecting end side toward a base end side.

3. A connector, comprising the terminal fitting of claim 1 accommodated in the connector housing.

* * * * *